US006907204B2

(12) United States Patent
Cho

(10) Patent No.: US 6,907,204 B2
(45) Date of Patent: Jun. 14, 2005

(54) METHOD OF CONTROLLING POWER OF A FIXING DEVICE OF ELECTRO-PHOTOGRAPHIC IMAGE FORMING APPARATUS IN PRINT STANDBY MODE

(75) Inventor: Durk-hyun Cho, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 29 days.

(21) Appl. No.: 10/446,131

(22) Filed: May 28, 2003

(65) Prior Publication Data

US 2004/0042810 A1 Mar. 4, 2004

(30) Foreign Application Priority Data

Jun. 24, 2002 (KR) ..... 10-2002-35414

(51) Int. Cl.[7] ..... G03G 15/20
(52) U.S. Cl. ..... 399/70
(58) Field of Search ..... 399/69, 70, 330, 399/334; 219/216, 469, 470; 432/60

(56) References Cited

U.S. PATENT DOCUMENTS 5,109,255 A * 4/1992 Nishikawa et al. ..... 399/70

FOREIGN PATENT DOCUMENTS

| | | |
|---|---|---|
| JP | 8-137327 | 5/1996 |
| KR | 1999-003577 | 1/1999 |

* cited by examiner

*Primary Examiner*—William J. Royer
(74) *Attorney, Agent, or Firm*—Staas & Halsey LLP

(57) ABSTRACT

A method of controlling the power of a fixing device of an electro-photographic image forming apparatus in a print standby mode and an apparatus to perform the method includes determining whether the electro-photographic image forming apparatus is in the print standby mode. If it is determined that the electro-photographic image forming apparatus is in the print standby mode, the temperature of the fixing device is adjusted to be between a first predetermined temperature, which is a high temperature, and a second predetermined temperature, which is a low temperature. The temperature of the fixing device increases from the second predetermined temperature to an operation temperature within 10 seconds. The second predetermined temperature is 100° C. or less. Accordingly, an FPOT upon a change from a print standby mode to a print mode is maintained at about 10 seconds or less, and simultaneously power consumption in the print standby mode is reduced about 75% due to a short period of power application to a heater and a long period of cooling of the heater.

15 Claims, 4 Drawing Sheets

METHOD OF CONTROLLING POWER OF A FIXING DEVICE OF ELECTRO-PHOTOGRAPHIC IMAGE FORMING APPARATUS IN PRINT STANDBY MODE

CROSS-REFERENCE TO RELATED APPLICATIONS

This application claims the priority of Korean Patent Application No. 2002-35414, filed Jun. 24, 2002, in the Korean Intellectual Property Office, the disclosure of which is incorporated herein by reference.

BACKGROUND OF THE INVENTION

1. Field of the Invention

The present invention relates to a method of controlling the power of a fixing device of an electro-photographic image forming apparatus, and more particularly, to a method of controlling the power of a fixing device employing a heat pipe in a print standby mode, by which instantaneous heating and low power consumption are possible.

2. Description of the Related Art

Electro-photographic image forming apparatuses include a fixing device to fix a toner image on a sheet by temporarily fusing toner image powder on the sheet on which the toner image has been transferred. The fixing device includes a fusing roller to fix the toner on the sheet and a pressure roller to press the sheet against the fusing roller.

FIG. 1 is a schematic longitudinal cross-section of a conventional fusing roller in which a halogen lamp serves as a heat source. FIG. 2 is a schematic latitudinal cross-section of a fixing device adopting the fusing roller of FIG. 1.

Referring to FIG. 1, a fusing roller 10 includes a cylindrical roller 11 and a halogen lamp 12 installed at the center of the inside of the cylindrical roller 11. A coated layer 11*a* (for example, coated with TEFLON) is formed on the circumference of the cylindrical roller 11. The halogen lamp 12 generates heat within the cylindrical roller 11, and accordingly the cylindrical roller 11 is heated by radiant heat from the halogen lamp 12.

Referring to FIG. 2, a pressure roller 13 is located beneath the fusing roller 10 while having a sheet 14 between the pressure roller 13 and the fusing roller 10. The pressure roller 13 is elastically supported by a spring 13*a* and presses the sheet 14 between the fusing roller 10 and the pressure roller 13 against the fusing roller 10 with a predetermined pressure. Toner image powder 14*a* formed on the sheet 14 is fixed on the sheet 14 by the predetermined pressure and heat while passing between the fusing roller 10 and the pressure roller 13.

At one side of the fusing roller 10 are installed a thermistor 15 to measure a surface temperature of the fusing roller 10, and a thermostat 16 to block power supplied to the halogen lamp 12 if the surface temperature of the fusing roller 10 exceeds a predetermined temperature. The thermistor 15 measures the surface temperature of the fusing roller 10 and transmits an electrical signal of the measured surface temperature to a controller (not shown) of a printer (not shown). The controller controls the amount of power supplied to the halogen lamp 12 depending on the measured surface temperature in order to maintain the surface temperature of the fusing roller 10 within a predetermined temperature range. If the temperature of the fusing roller 10 exceeds a temperature limit due to malfunctions of the thermistor 15 and the controller, the thermostat 16 blocks power flowing to the halogen lamp 12 by opening a contact (not shown).

The fusing roller 10 employing the halogen lamp 12 as a heat source consumes a great amount of power and has a low temperature increase rate. In particular, when the power of an image forming apparatus is turned on, a significantly long warm up is needed.

FIG. 3 is a graph showing a temperature profile with respect to a timing of alternating current (AC) power supplied to the halogen lamp 12 of the conventional fusing roller 10. Referring to FIG. 3, t1 denotes a time to operate an image forming apparatus, and t2 denotes a time when the temperature of the fusing roller 10 of the image forming apparatus reaches a target fusing temperature (185° C.). The interval between t1 and t2 denotes the warm-up period of the fusing roller 10. During the interval between t1 and t2, an AC voltage is continuously supplied to the halogen lamp 12, a temperature increase rate of the fusing roller 10 is 4–5° C./sec, and the warm-up period is about 35–40 seconds.

The interval between t2 and t3 denotes a print mode interval, and t3 denotes a time when the image forming apparatus enters into a print standby mode. During the interval between t2 and t3, the supply of power (i.e., the turning on and off of power) to the halogen lamp 12 is controlled in order to maintain the temperature of the fusing roller 10 at a predetermined temperature. For ease of illustration, frequent AC power on-off control is indicated by AC power 'on' in FIG. 3.

At t3, power is not supplied to the halogen lamp 12, and thus the temperature of the fusing roller 10 decreases. Given that the temperature rising rate of the conventional fusing roller 10 is 4–5° C./sec, and the time to change from the print standby mode to the print mode is less than 10 seconds, the temperature of the fusing roller 10 must be maintained at about 140° C. Hence, if the temperature of the fusing roller 10 is cooled from 185° C. to about 140° C., power is supplied to the halogen lamp 12, at t4. The supply of power (i.e., whether to supply power or not) to the halogen lamp 12 is controlled to maintain the temperature of the fusing roller 10 at the predetermined temperature. For ease of illustration, frequent AC power on-off control is indicated by AC power 'on' in FIG. 3.

In the case when the halogen lamp 12 is used as the heat source of the fusing roller 10, since a temperature of the fusing roller 10 rises at 4–5° C./sec, the surface temperature of the fusing roller 10 must be maintained at a relatively high temperature, about 140° C., in order to adjust a first print out time (FPOT) during a change from the print standby mode to the print mode in 10 seconds. Thus, a great amount of power is consumed in the print standby mode. Generally, in the case of a halogen lamp of 400 to 500 Watt/hour, power of about 250 Watt/hour is consumed in the print mode, and power of about 70 Watt/hour is consumed in the print standby mode.

SUMMARY OF THE INVENTION

Accordingly, it is an aspect of the present invention to provide a method of controlling power supplied to a fixing device in a print standby mode to obtain a short FPOT upon a change from the print standby mode to a print mode and reduce the amount of power consumed in the print standby mode.

Additional aspects and advantages of the invention will be set forth in part in the description which follows and, in part, will be obvious from the description, or may be learned by practice of the invention.

The foregoing and/or other aspects are achieved by providing a method of controlling power of a fixing device of an electro-photographic image forming apparatus in a print standby mode. The electro-photographic image forming apparatus includes the fixing device having a heat pipe which contains a working fluid, to fix toner onto a sheet; a power supply to supply power to a heater installed in the fixing device; a fusing temperature measurer to measure the temperature of the fixing device; and a controller to compare the temperature measured by the fusing temperature measurer with a predetermined temperature and to control power from the power supply to the heater. In the method, it is determined whether the electro-photographic image forming apparatus is in a print standby mode. If it is determined that the electro-photographic image forming apparatus is in the print standby mode, the temperature of the fixing device is adjusted within the range from a first predetermined temperature, which is a high temperature, to a second predetermined temperature, which is a low temperature. The temperature of the fixing device increases from the second predetermined temperature to an operation temperature within 10 seconds, and the second predetermined temperature is 100° C. or less.

The second predetermined temperature may be 85° C. or less, and the amount of power consumed by the fusing roller during the standby mode may be 20 Watt/hour or less.

In the print standby mode determination operation, if a first predetermined period of time lapses after a print operation in a print mode, or if the print standby mode is within a second predetermined period of time, it is determined that the electro-photographic image forming apparatus is in the print standby mode.

Alternatively, if a predetermined signal is received from an external input unit, it is determined that the electro-photographic image forming apparatus is in the print standby mode.

The temperature of the fixing device may be adjusted by measuring the temperature of the fixing device, comparing the measured temperature with the second predetermined temperature, blocking power from going to the heater if the measured temperature is greater than the second predetermined temperature, and supplying power to the heater if the measured temperature is smaller than the second predetermined temperature.

In the power supplying operation, power is supplied to the heater until the measured temperature of the fixing device increases to the first predetermined temperature.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
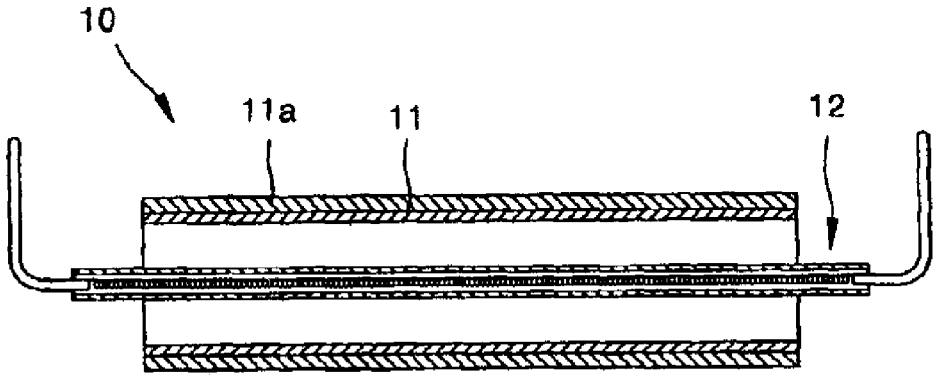
FIG. 1 (PRIOR ART)
FIG. 1 is a schematic longitudinal cross-section of a conventional fusing roller in which a halogen lamp serves as a heat source.
Figure 2:
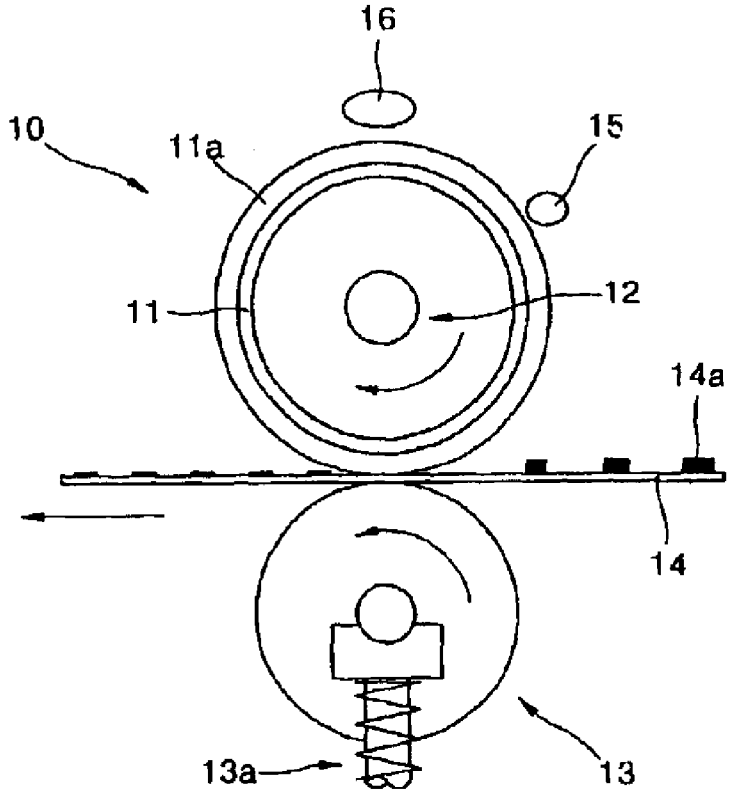
FIG. 2 (PRIOR ART)
FIG. 2 is a schematic latitudinal cross-section of a fixing device adopting the fusing roller of FIG. 1.
Figure 3:
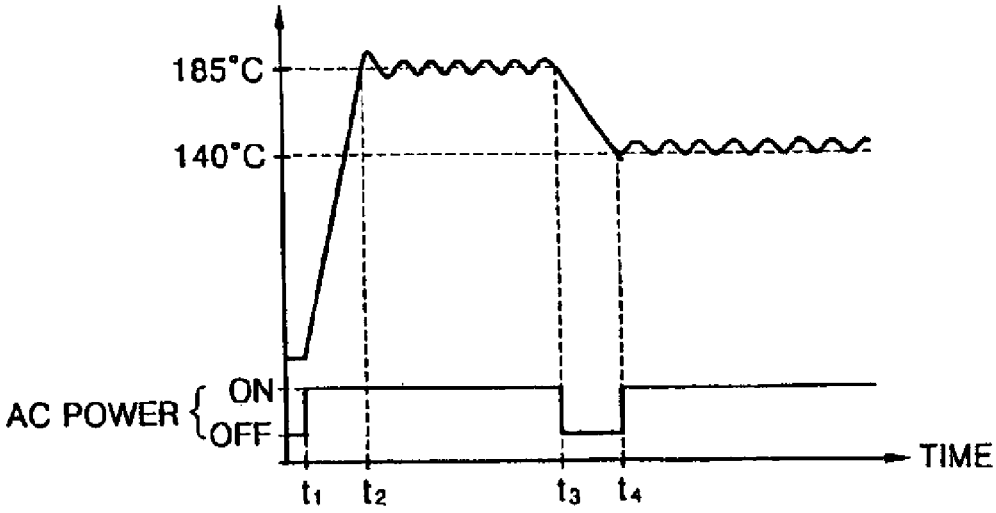
FIG. 3 (PRIOR ART)
FIG. 3 is a graph showing a temperature profile of the conventional fusing roller of FIG. 1 and a timing of AC power supplied to the halogen lamp.

Reference will now be made in detail to the present preferred embodiment of the present invention, an example of which is illustrated in the accompanying drawings, wherein like reference numerals refer to like elements throughout.

Figure 4:
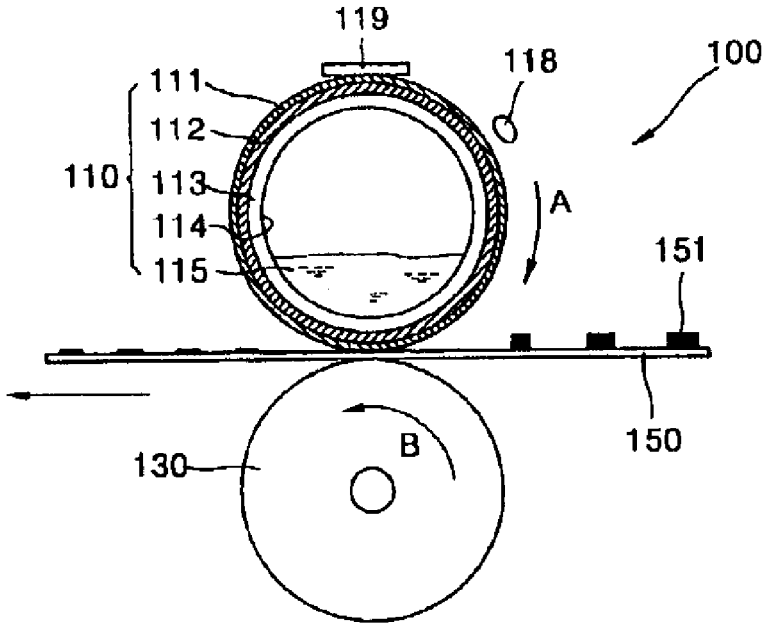
FIG. 4 is a schematic longitudinal cross-section of a fixing device of an electro-photographic image forming apparatus to which a power controlling method according to an embodiment of the present invention is applied.

Referring to FIG. 4, a fixing device 100 includes a fusing roller 110 and a pressure roller 130. The fusing roller 110 rotates in a direction 'A' to discharge a sheet 150 having a toner image 151 thereon. The pressure roller 130 is installed on the bottom surface of the sheet 150 whose upper surface contacts the fusing roller 110, and rotates in direction 'B' while pressing the sheet 150 against the fusing roller 110.

To be more specific, the fusing roller 110 includes a cylindrical roller 112, a heater 113, and a heat pipe 114. A toner protective layer 111 coated with TEFLON is formed on the cylindrical roller 112. The heater 113 is spirally installed on an inner surface of the cylindrical roller 112 to receive electricity from an external power source and generate heat. The heat pipe 114 is installed on an inner surface of the heater 113 and has both ends sealed. The heat pipe 114 contains a working fluid 115 with a predetermined volume.

A thermistor 118 is installed above the toner protective layer 111 and measures the surface temperature of the fusing roller 110. A thermostat 119 is installed over the fusing roller 110 and blocks power from going to the heater 113 to prevent overheating if the surface temperature of the fusing roller 110 sharply increases. The heater 113 may be a resistive heating coil which spirally wraps around the heat pipe 114.

The heat pipe 114 is made airtight by closing both ends, and contains a predetermined amount of the working fluid 115. The working fluid 115 is vaporized by heat received from the heater 113 and transmits the heat of vaporization to the cylindrical roller 112 so that the entire cylindrical roller 112 is evenly heated within a short period of time without a temperature deviation of the surface of the cylindrical roller 112. The working fluid 115 occupies 5–50%, i.e., 5–15%, of the volume of the heat pipe 114. A volume percentage of the working fluid 115 that is less than 5% may result in dry out.

The material of the working fluid 115 can be selectively used depending on the material of the heat pipe 114. In other words, if the heat pipe 114 is made of stainless steel, the working fluid 115 can be any one of well-known working fluids except for water, for example, FC-40(3M).

If the heat pipe 114 is made of copper (Cu), the working fluid 115 can be any one of well-known working fluids including water, i.e., distilled water. The use of water lowers manufacturing costs and does not cause environmental pollution.

The cylindrical roller 112 is heated by heat received from the heater 113 or by the heat of vaporization from the working fluid 115 contained in the heat pipe 114 in order to fuse the toner image 151 formed on the sheet 150 and fix the same onto the sheet 150. The cylindrical roller 112 is made of stainless steel, aluminium (Al), or copper (Cu).

Figure 5:
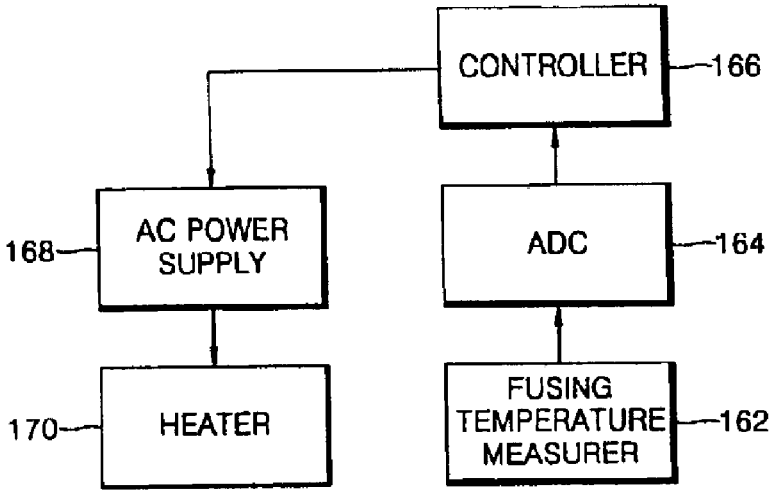
FIG. 5 is a block diagram of a power controlling apparatus for performing a power controlling method for a fixing device according to an embodiment of the present invention.

FIG. 5 is a block diagram of a power controlling apparatus to perform a power controlling method for a fixing device according to the embodiment of the present invention. Referring to FIG. 5, a fusing temperature measurer 162 measures the surface temperature of the fusing roller 110 at intervals of a predetermined period, e.g., 100 ms.

An analog value corresponding to a temperature measured by the fusing temperature measurer 162 is converted into a digital value by an analog-to-digital converter (ADC) 164, and the digital value is transmitted to a controller 166.

The controller 166 performs calculations necessary to control the electro-photographic forming apparatus. That is, the controller 166 compares the measured temperature with a predetermined temperature and outputs a signal to control a heater 170 to an AC power supply 168. The AC power supply 168 supplies or blocks AC power to the heater 170 based on the control signal of the controller 166, that is, an on-off signal.

The fusing temperature measurer 162 and the heater 170 correspond to the thermistor 118 and the heater 113 of FIG. 4, respectively, and accordingly, will not be described in greater detail.

Figure 6:
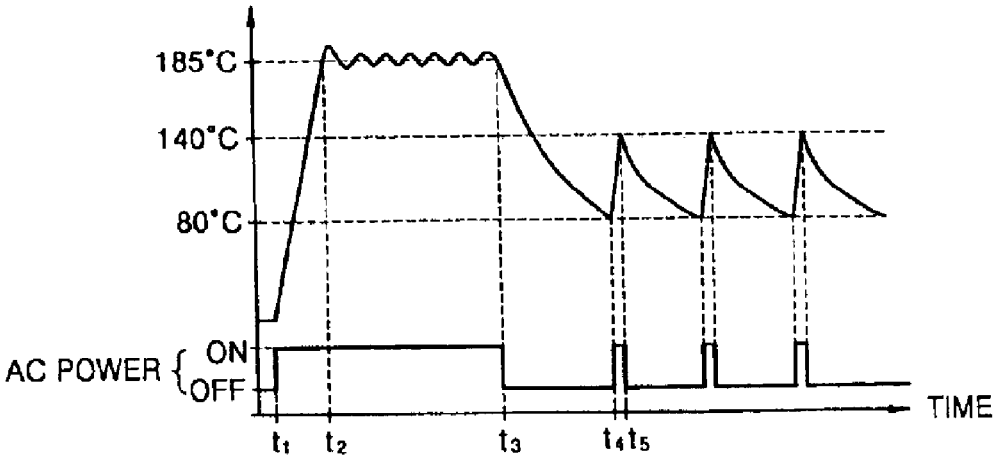
FIG. 6 is a graph showing a temperature profile of the fusing roller of FIG. 4 and a timing of AC power supplied to the heater of FIG. 5.

FIG. 6 is a graph showing a temperature profile of the fusing roller 110 of FIG. 4 and a timing of the AC power supplied to the heater 170 of FIG. 5, with respect to time.

In the graph of FIG. 6, t1 denotes a time to operate the electro-photographic image forming apparatus, and t2 denotes a time when the temperature of the fusing roller 110 of the electro-photographic image forming apparatus reaches a target fusing temperature, i.e., 185° C. The interval between t1 and t2 denotes a warm-up period of the fixing device 100. During the interval between t1 and t2, an AC voltage is continuously supplied to the heater 170. A temperature increase rate of the fusing roller 110 is 8–15° C./sec, and the warming-up period is about 10–20 seconds.

The interval between t2 and t3 denotes a print mode interval, and t3 denotes a time when the electro-photographic image forming apparatus enters into a print standby mode. During the interval between t2 and t3, the supply of power (i.e., whether to supply power or not) to the heater 170 is controlled in order to maintain the temperature of the fusing roller 110 at a predetermined temperature. For ease of illustration, in FIG. 6, frequent AC power on-off control is indicated by AC power 'on'.

At t3, power is blocked from going to the heater 170, and thus the temperature of the fusing roller 110 decreases. Here, the temperature cooling rate of the fusing roller 110 varies from 5 to 10° C./min depending on the type of the working fluid 115, the usage amount of the working fluid 115, the material of the heat pipe 114, or the like. After t4, when the temperature of the fusing roller 110 measured by the fusing temperature measurer 162 reaches a certain temperature, e.g., 80° C., the controller 166 increases the temperature of the fusing roller 110 to 140° C. In other words, during the interval between t4 and t5, AC power is supplied to the heater 170. If the temperature increasing speed of the fusing roller 110 is 10° C./sec, the AC power can be supplied to the heater 170 for about 6 seconds. Thereafter, at t5, if a power supply to the heater 170 is cut off, the fusing roller 110 is again cooled. Here, if the cooling rate of the fusing roller 110 is 6° C./min, the cooling time is about 10 minutes. In the print standby mode, cooling and increasing the temperature of the fusing roller 110 are repeated, and the power consumed by the fusing roller 110 is about 17 Watt/hour.

Figure 7:
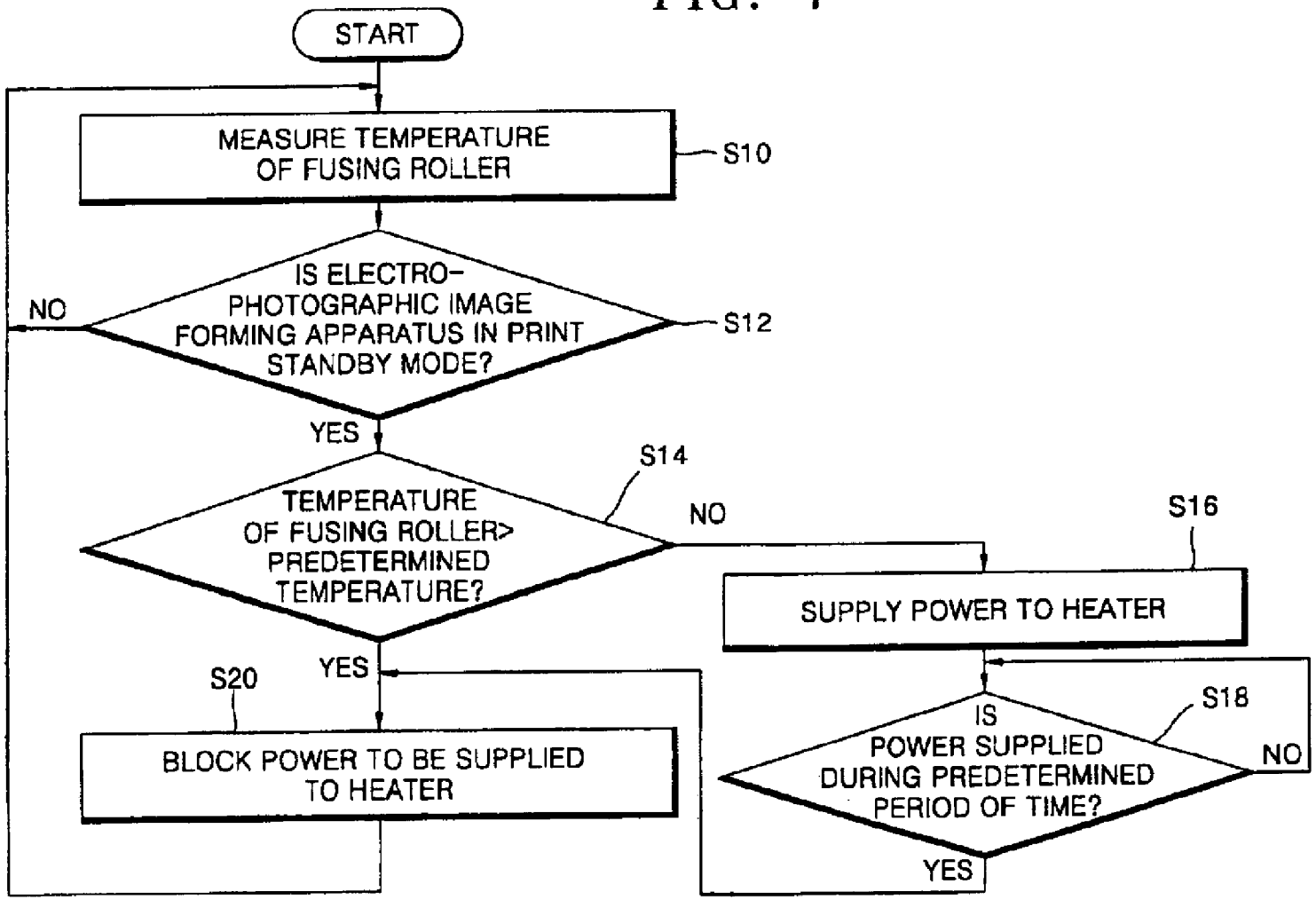
FIG. 7 is a flowchart illustrating a power controlling method for the fixing device of FIG. 4, according to the embodiment of the present invention.

FIG. 7 is a flowchart illustrating a method of controlling power supplied to the fixing device 100 in a print standby mode, according to the embodiment of the present invention. Referring to FIGS. 4 through 7, in S10, the fusing temperature measurer 162 measures the temperature of the fusing roller 110 at intervals of a predetermined period, e.g., 100 ms and transmits an analog signal associated with the measured temperature to the ADC 164, and the ADC 164 converts the received analog signal into a digital signal and outputs the digital signal to the controller 166.

In S12, the controller 166 determines whether the electro-photographic image forming apparatus is in a print standby mode. The controller 166 determines that the electro-photographic image forming apparatus is in the print standby mode if no new print operations exist until a first predetermined period of time lapses after the previous print operation has been completed. Alternatively, a user may input a print standby mode to the controller 166 using an external input unit. If no new print operations exist in the print standby mode within a second predetermined period of time, the print standby mode is changed to an energy saving mode. Accordingly, the supply of power to the heater 170 is blocked until a print operation is commanded.

In S14, if it is determined in S12 that the electro-photographic image forming apparatus is in a print standby mode, the controller 166 compares the temperature of the fusing roller 110 with a predetermined temperature, e.g., 80° C.

On the other hand, if it is determined in S12 that the electro-photographic image forming apparatus is not in a print standby mode, the method goes back to S10.

If it is determined in S14 that the temperature of the fusing roller 110 is greater than the predetermined temperature, the controller 166 blocks power from going to the heater 170, in S20.

On the other hand, if it is determined in S14 that the temperature of the fusing roller 110 is equal to or less than the predetermined temperature, power is supplied to the heater 170, in S16.

In S18, it is determined whether the time required to supply power to the heater 170 exceeds a predetermined period of time, e.g., 6 seconds.

If it is determined in S18 that power is supplied during the predetermined period of time, the method goes to S20, and accordingly power is blocked from being supplied to the heater 170. On the other hand, if it is determined in S18 that the predetermined period of time has not passed, a power supply to the heater 170 is continued.

As described above, in a method of controlling power supplied to a fusing roller in a print standby mode, an FPOT upon a change from a print standby mode to a print mode is maintained at about 10 seconds or less, and simultaneously power consumption in the print standby mode is reduced about 75% due to a short period of power provision to the fusing roller and a long cooling period of the fusing roller.

Although an embodiment of the present invention has been shown and described, it will be appreciated by those skilled in the art that changes may be made in this embodiment without departing from the principles and spirit of the invention, the scope of which is defined in the claims and their equivalents.

What is claimed is:

1. A method of controlling power of a fixing device of an image forming apparatus in a print standby mode, the fixing device having a fusing roller to fix toner onto a sheet, the method comprising:

measuring a temperature of the fusing roller;

determining whether the measured temperature of the fusing roller has reached a first standby mode temperature, which is lower than a target fusing temperature; and controlling the temperature of the fusing roller to be between the first standby mode temperature and a second standby mode temperature, when the measured temperature of the fusing roller has reached the first standby mode temperature, wherein the second standby mode temperature is higher than the first standby mode temperature and lower than the target fusing temperature.

2. The method of claim 1, further comprising increasing the temperature of the fusing roller from the first standby mode temperature to the second standby mode temperature within 10 seconds.

3. The method of claim 1, wherein the first standby mode temperature is 100° C. or less.

4. A method of controlling power of a fixing device of an image forming apparatus in a print standby mode, the fixing device having a fusing roller to fix toner onto a sheet and a heater to heat the fusing roller, the method comprising:

measuring a temperature of the fusing roller;

determining whether the measured temperature of the fusing roller has reached a standby mode temperature, which is lower than a target fusing temperature;

supplying power to the heater for a predetermined period of time to increase the temperature of the fusing roller to a predetermined temperature between the standby mode temperature and the target fusing temperature, when the measured temperature of the fusing roller has reached the standby mode temperature; and decreasing the temperature of the fusing roller from the predetermined temperature to the standby mode temperature.

5. The method of claim 4, wherein the predetermined period of time is less than 10 seconds.

6. The method of claim 5, wherein the standby mode temperature is 100° C. or less.

7. The method of claim 4, wherein the temperature decreasing comprises blocking the power supplied to the heater.

8. A method of controlling power of a fixing device of an image forming apparatus in a print standby mode, the fixing device having a fusing roller to fix toner onto a sheet and a heater to heat the fusing roller, the method comprising:

measuring a temperature of the fusing roller;

determining whether the measured temperature of the fusing roller has reached a standby mode temperature, which is lower than a target fusing temperature;

increasing the temperature of the fusing roller to a predetermined temperature between the standby mode temperature and the target fusing temperature, when the measured temperature of the fusing roller has reached the standby mode temperature; and decreasing the temperature of the fusing roller from the predetermined temperature to the standby mode temperature.

9. The method of claim 8, wherein the increasing of the temperature comprises increasing the temperature of the fusing roller from the standby mode temperature to the predetermined temperature within 10 seconds.

10. The method of claim 9, wherein the standby mode temperature is 100° C. or less.

11. The method of claim 8, wherein the temperature decreasing comprises blocking a power supplied to the heater.

12. A method of controlling power of a fixing device of an image forming apparatus in a print standby mode, the fixing device having a fusing roller to fix toner onto a sheet and a heater to heat the fusing roller, the method comprising:

measuring a temperature of the fusing roller;

determining whether the measured temperature of the fusing roller has reached a standby mode temperature, which is lower than a target fusing temperature;

supplying power to the heater for a first period of time to increase the temperature of the fusing roller to a predetermined temperature between the standby mode temperature and the target fusing temperature, when the measured temperature of the fusing roller has reached the standby mode temperature; and decreasing the temperature of the fusing roller from the predetermined temperature to the standby mode temperature for a second period of time after the first period of time, wherein the second period of time is longer than the first period of time.

13. The method of claim 12, wherein the first period of time is less than 10 seconds, and the second period of time is 20 or more times longer than the first period of time.

14. The method of claim 13, wherein the standby mode temperature is 100° C. or less.

15. The method of claim 12, wherein the temperature decreasing comprises blocking the power supplied to the heater.

* * * * *